US006774326B2

(12) United States Patent
Rochard et al.

(10) Patent No.: US 6,774,326 B2
(45) Date of Patent: Aug. 10, 2004

(54) SWITCH WITH A REMOVABLE CONNECTOR

(75) Inventors: Michel Rochard, Ruelle (FR); Didier Severac, Rueil-Malmaison (FR)

(73) Assignee: Schneider Electric Industries SAS (FR)

( * ) Notice: Subject to any disclaimer, the term of this patent is extended or adjusted under 35 U.S.C. 154(b) by 0 days.

(21) Appl. No.: 10/270,316

(22) Filed: Oct. 15, 2002

(65) Prior Publication Data

US 2003/0070907 A1 Apr. 17, 2003

(30) Foreign Application Priority Data

Oct. 12, 2001 (FR) ..... 01 13403

(51) Int. Cl.[7] ..... H01H 1/64; H01H 1/66
(52) U.S. Cl. ..... 200/293; 439/347; 439/364
(58) Field of Search ..... 200/293; 439/347, 439/364, 372, 374, 297, 487

(56) References Cited

U.S. PATENT DOCUMENTS 4,710,136 A * 12/1987 Suzuki ..... 439/297
5,395,261 A * 3/1995 Addison et al. ..... 439/310
5,453,589 A 9/1995 Mayer ..... 200/302.1
5,825,627 A * 10/1998 Tamura ..... 361/730
6,543,821 B1 * 4/2003 Weinerman et al. ..... 292/123
6,616,472 B2 * 9/2003 Lee ..... 439/342

FOREIGN PATENT DOCUMENTS

| | | |
|---|---|---|
| DE | 85 27 935.8 | 10/1985 |
| DE | 296 21 455 U1 | 12/1996 |
| EP | 0 790 628 A3 | 2/1996 |
| EP | 0 790 628 A2 | 2/1996 |

* cited by examiner

*Primary Examiner*—Lincoln Donovan
*Assistant Examiner*—K. Lee
(74) *Attorney, Agent, or Firm*—Parkhurst & Wendel, L.L.P.

(57) ABSTRACT

A switch including a switch box housing an electrical switching assembly, the box having a front part, a middle part and a back part that has two lateral wing-shaped walls, with a detection head located in the front part and a removable cable connector located in the back part for connecting a cable to output contacts, wherein the removable cable connector is located in the switch box between the wing-shaped walls, and has a body having at least one surface for releasable attachment to the switch box by the locking mechanism, and the electrical switching assembly and the body of the removable cable connector are substantially identical in width and depth to a transverse cross-sectional dimension of the switch box, and are housed for removable insertion one behind the other lengthwise in the switch box for electrical connection therebetween.

8 Claims, 2 Drawing Sheets

SWITCH WITH A REMOVABLE CONNECTOR

FIELD OF THE INVENTION

This invention concerns a switch, comprising a template box whose outer shape is roughly prismatic, equipped on the front part with a motion or object presence detection head, housing an electric switching assembly, equipped at the back with output contacts, and, with a removable cable connector on a back part to connect a cable to the output contacts.

BACKGROUND OF THE INVENTION

It is usual to connect these switches to a wide variety of connectors, which differ depending on the type of connection, the number of pins, the length of the cable attached to the connector body, or even by the cable outlet direction, etc. In practice, this requires the manufacturer to produce a multitude of switch references because of the different connectors associated with them. Moreover, it is desirable to integrate the connector in the switch box, particularly to avoid any impractical protrusions in an industrial machine environment.

SUMMARY OF THE INVENTION

The invention aims to integrate the connector in the box of such a switch in a simple manner, enabling the box to be associated with various connectors, and the connector or the electric switching assembly to be changed, preferably without modifying the box.

According to the invention, the switch box determines a housing for the switching assembly and the connector, and for this purpose, has two large lateral surfaces, contributing to definition of the outer template of the box, and forming partitions at the back part of the box, used as fitting wings for the connector. The connector body is fitted so that it can be detached from the housing between the wings, equipped with at least one partition inside the roughly prismatic template of the box and fastened in the housing by a locking mechanism.

The connector therefore does not protrude from the prismatic template of the box and remains protected. It is preferable that a back surface of the body forms the back surface of the box, and a lateral surface of the body forms part of the lateral surface of the box, enabling the cable to come out via the back or side. The switching assembly and the connector body are preferably inserted one behind the other in the switch box housing, which has a rectangular cross-section, as they have cross-sections that are roughly identical and suited to the housing.

Connector assembly and disassembly are simplified by the locking mechanism, which is preferably provided at the back of the connector body, with a rotatable element, such as a quarter-turn rotational element, accessible from the back surface and at least one latching element able to engage on a stop element provided in a wing of the box. The latching element can then be formed by two tongues provided on the sides opposite the rotating rotatable element to each operate with a slot provided in the opposite wings, between which the connector body is fitted. A seal placed against the internal wall of the housing, next to the electric switching assembly, is pressurised by the connector body's locking mechanism.

BRIEF DESCRIPTION OF THE DRAWINGS

The description given below is of a non-limiting production method of the invention, supported by the attached drawings.

DESCRIPTION OF THE EMBODIMENTS

The switch shown is a position switch, i.e. a switch with a lever or a push button sensitive to the approach of an external object, translating this detection into an outgoing electric signal. The switch considered may also be produced as a contact-less proximity sensor.

Figure 1:
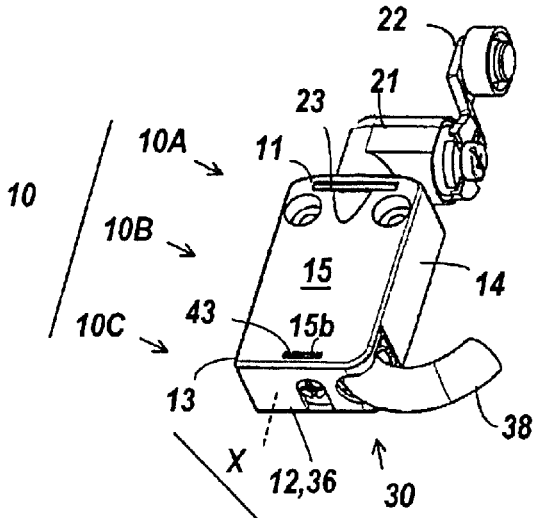
FIG. 1 shows a perspective view of a position switch according to the invention.
Figure 2:
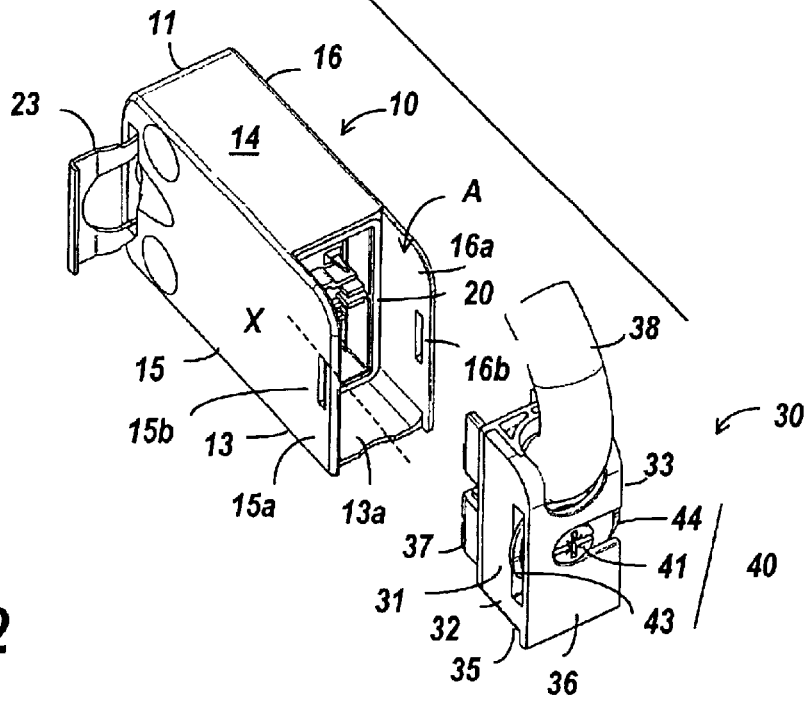
FIG. 2 is an exploded perspective view showing the switch box and connector.
Figure 3:
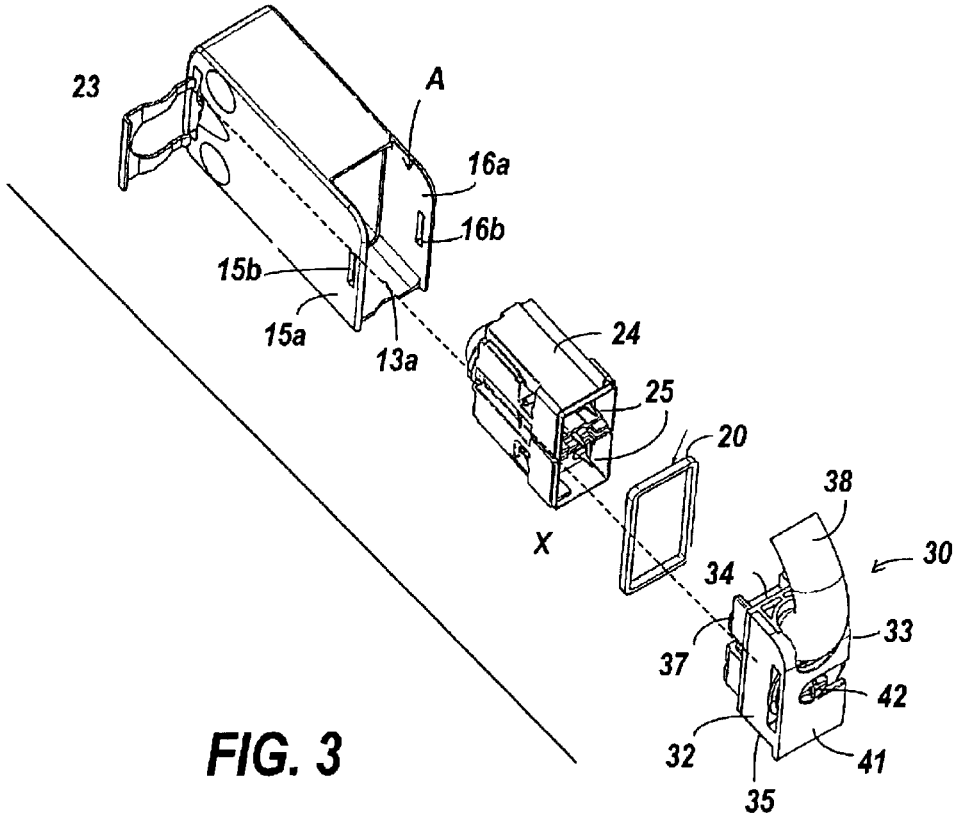
FIG. 3 is another exploded perspective view, on a smaller scale, of the switch.

The position switch shown on FIG. 1 has a box 10, roughly prismatic in shape, with a front part 10A, a median part 10B and a back part 10C. On the front part 10A, a rotatable head 21 is fixed, equipped with a lever 22 that is able to rotate when an object comes into contact with it. The box 10 has a housing A, of a roughly rectangular cross-section, so that a contact block—or an electronic block—24 fits into the median part 10B of the box 10 (see FIG. 3) and a detachable connector 30 fits into the back part 10C of the box.

In greater detail, the box 10 of the switch has more or less flat surfaces: one front surface 11, one back surface 12, two small lateral surfaces 13,14 and two large lateral surfaces 15,16 forming a prismatic template—or casing—. The back part of the large lateral surfaces 15,16 each forms a fitting wing 15*a*, 16*a* equipped with a slot-shaped opening 15*b*, 16*b* respectively, parallel to the adjacent back surface plane 12. The lateral surface 13 also has a fitting wing 13*a* on its back part, whereas the lateral surface 14 has no corresponding wing. Thus, the wings 15*a*, 16*a*, 13*a* define an opening towards the back and side of surface 14 for the housing A.

The rotatable head 21 is fixed so that it can be removed from the box 10 using a fork 23 that can be inserted into the box. The contact block 24 is inserted so that it can be removed from the box 10 in the main direction X of the switch, and has plug output contacts 25 at the back. A rectangular seal 20 is placed in the median part of housing A between the contact block 24 and the connector 30 to ensure tightness of the contact block. The contact block is, in this case, electromechanical; it may also include an electronic processing circuit.

The detachable connector 30 has a body 31 that is fitted and practically built into the housing A behind the contact block. The connector 30 has large lateral surfaces 32,33 that are engaged in the housing A, in parallel and adjacent to the wings 15*a*,16*a* of the large surfaces 15,16 of the box. It also has a small lateral surface 34 located in the extension of the small surface 14 of the box and a small lateral surface 35 engaged in the housing A, in parallel and adjacent to the wing 13*a*. The body 31 of the connector 30 has a back surface 36 that forms the majority, or preferably all, of the back surface 12 of the switch box. On the front, the connector 30 has socket contacts 37 to operate with at least some of the plug contacts 25 of block 24. A cable 38 is linked to the body 31 to come out at an angle of 45°, as shown on the figures, or parallel to the length of the box 10, depending on the type of connector required.

A locking mechanism 40 is provided at the back of the connector, associated with its back surface. The mechanism 40 is, for example, a quarter-turn rotating mechanism, and includes a rotatable screw, or similar device, 41, accessible from the back surface 36 and linked to a rotating cam 42 with two lateral lugs 43,44, that form the tongues latching in the slots 15*b*,16*b*. When the lugs 43,44 engage in the slots, the cam effect causes the front edge of the body 31 to be applied against the seal 20, resulting in satisfactory tightening of the seal. The mechanism 40 thus confirms fixture of the connector after plugging in and forms the seal of the electric part of the switch.

It should be observed that the contact block 24 and the body 31 of the connector 30 are roughly identical in length and width to the transversal cross-section of housing A of the box 10; by its back surface 36 and lateral surface 34, the connector fits in the prismatic template of the switch box, while remaining firmly held by the wings 15*a*,16*a*,13*a* and locked by the locking mechanism 40.

What is claimed is:

1. A switch comprising:

a detection head;

an electrical switching assembly having a plurality of output contacts located on a back surface thereof;

a removable cable connector;

a locking mechanism located on the cable connector;

a switch box housing the electrical switching assembly and comprising a front part, a middle part and a back part, with the detection head located in the front part and the removable cable connector located in the back part for connecting a cable to the output contacts, the back part of the switch box comprising two lateral wing-shaped walls, wherein:

the removable cable connector comprises a body and is located in the switch box between the wing-shaped walls, the body having at least one surface for releasable attachment to the switch box by the locking mechanism, and the electrical switching assembly and the body of the removable cable connector are substantially identical in width and depth to a transverse cross-sectional dimension of the switch box, and are housed in the middle part and the back part, respectively, of the switch box, for removable insertion one behind the other lengthwise in the switch box for electrical connection therebetween.

2. The switch according to claim 1, wherein the back part of the switch box comprises a back wall and a lateral wall and a back wall of the connector body is also the back wall of the switch box and a lateral wall of the connector body is a part of the lateral wall of the box.

3. The switch according to claim 1, further comprising a stop element located on one of said wing-shaped walls, wherein the locking mechanism is located at the back of the connector, and comprises a rotatable element accessible from the back wall of the connector body and at least one latching element for engaging the stop element.

4. The switch according to claim 3, wherein the locking mechanism comprises a quarter-turn fixing device.

5. The switch according to claim 4, wherein the quarter-turn fixing device comprises two latching tongues located on opposite sides of the rotatable element and each said latching tongue for operating with a slot in one of said wing-shaped walls of the switch box.

6. The switch according to claim 1, further comprising a seal located against an internal surface of the wing-shaped walls adjacent to the switching assembly, between the switching assembly and a front part of the connector body, wherein the locking mechanism is for application of pressure to the seal.

7. The switch according to claim 1, wherein the detection head is a motion detection head.

8. The switch according to claim 1, wherein the detection head is an object sensing head.

* * * * *